US007150412B2

(12) United States Patent
Wang et al.

(10) Patent No.: US 7,150,412 B2
(45) Date of Patent: Dec. 19, 2006

(54) METHOD AND APPARATUS FOR ELECTROSTATIC SPRAY

(75) Inventors: Shaupoh Wang, Chesterfield, MO (US); Jeffry Golden, Creve Coeur, MO (US); Christopher G. Kocher, Belleville, IL (US)

(73) Assignee: Clean Earth Technologies LLC, St. Louis, MO (US)

( * ) Notice: Subject to any disclaimer, the term of this patent is extended or adjusted under 35 U.S.C. 154(b) by 137 days.

(21) Appl. No.: 10/632,891

(22) Filed: Aug. 1, 2003

(65) Prior Publication Data

US 2004/0050946 A1 Mar. 18, 2004

Related U.S. Application Data

(60) Provisional application No. 60/401,563, filed on Aug. 6, 2002.

(51) Int. Cl.
*B05B 1/08* (2006.01)
*B05B 5/00* (2006.01)
*F23D 11/32* (2006.01)

(52) U.S. Cl. ..... 239/102.1; 239/690; 239/690.1; 239/698; 239/704; 239/705

(58) Field of Classification Search ..... 239/690, 239/690.1, 697, 698, 704, 705, 706, 707, 239/708, 102.1
See application file for complete search history.

(56) References Cited

U.S. PATENT DOCUMENTS

| | | | | |
|---|---|---|---|---|
| 1,219,642 A | | 3/1917 | Isaacs | |
| 2,410,532 A | | 11/1946 | Tessier | 299/140 |
| 3,065,106 A | | 11/1962 | Rhodes et al. | 117/93 |
| 3,911,161 A | | 10/1975 | Nord et al. | 427/30 |
| 3,940,061 A | | 2/1976 | Gimple et al. | 239/15 |
| 4,004,733 A | | 1/1977 | Law | 239/3 |
| 4,009,829 A | | 3/1977 | Sickles | 239/15 |
| 4,106,697 A | | 8/1978 | Sickles et al. | 239/15 |
| 4,255,777 A | | 3/1981 | Kelly | 361/228 |
| 4,335,419 A | | 6/1982 | Hastings | 361/228 |
| 4,347,984 A | * | 9/1982 | Sickles | 239/690.1 |
| 4,508,265 A | | 4/1985 | Jido | 239/3 |
| 4,605,485 A | | 8/1986 | Cerkanowicz | 204/302 |
| 4,630,169 A | | 12/1986 | Kelly | 361/225 |
| 4,664,315 A | * | 5/1987 | Parmentar et al. | 239/706 |
| 4,854,506 A | * | 8/1989 | Noakes et al. | 239/691 |
| 4,934,603 A | * | 6/1990 | Lasley | 239/527 |
| 4,991,774 A | | 2/1991 | Kelly | 239/3 |
| 5,297,738 A | | 3/1994 | Lehr et al. | 239/708 |
| 5,518,546 A | * | 5/1996 | Williams et al. | 118/621 |
| 5,704,554 A | | 1/1998 | Cooper et al. | 239/690.1 |
| 5,779,162 A | * | 7/1998 | Noakes et al. | 239/690.1 |
| 5,941,465 A | * | 8/1999 | Richards | 239/690.1 |
| 5,947,377 A | | 9/1999 | Hansinger et al. | 239/3 |

(Continued)

FOREIGN PATENT DOCUMENTS

| | | |
|---|---|---|
| DE | 7600132 | 6/1977 |
| GB | 591474 | 9/1947 |

*Primary Examiner*—Davis Hwu
(74) *Attorney, Agent, or Firm*—Husch & Eppenberger, LLC; Grant D. Kang

(57) ABSTRACT

A method and apparatus to improve the atomization of liquid and the efficiency of depositing liquid particles onto target objects, or to coat the target object with a thin film of liquid, to reduce the risk of high-voltage electrical shock, and to reduce the weight of an electrostatic spray system has been developed by inducing electrostatic charges onto the atomized liquid particles sprayed from a grounded metal nozzle.

19 Claims, 14 Drawing Sheets

U.S. PATENT DOCUMENTS 6,003,794 A 12/1999 Hartman et al. ..... 239/695
6,053,437 A 4/2000 Hansinger et al. ..... 239/703
6,138,922 A 10/2000 Hartman et al. ..... 239/3
6,227,466 B1 5/2001 Hartman et al. ..... 239/704

* cited by examiner

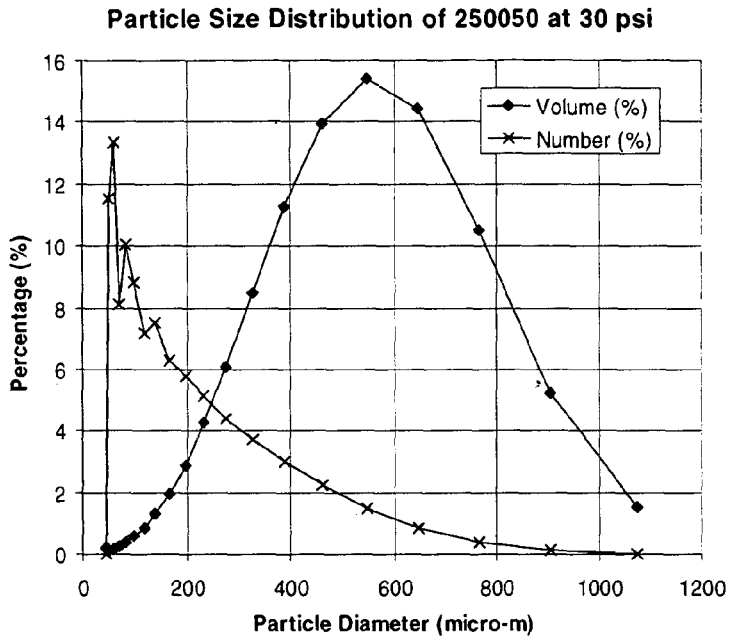
Figure 8. Size distribution of water aerosols sprayed at 30 psi with 250050 nozzle made by Spray System Co. (The data is provided by Spray System Co.)

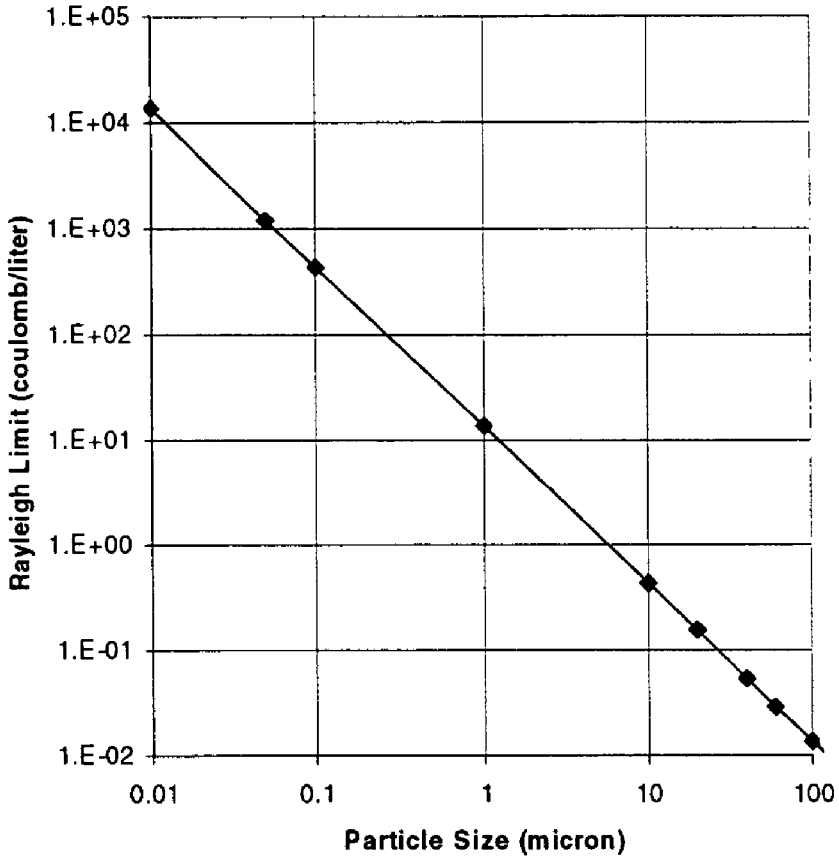
Figure 9. Maximum charge density on water aerosols based on the aerosol's diameter

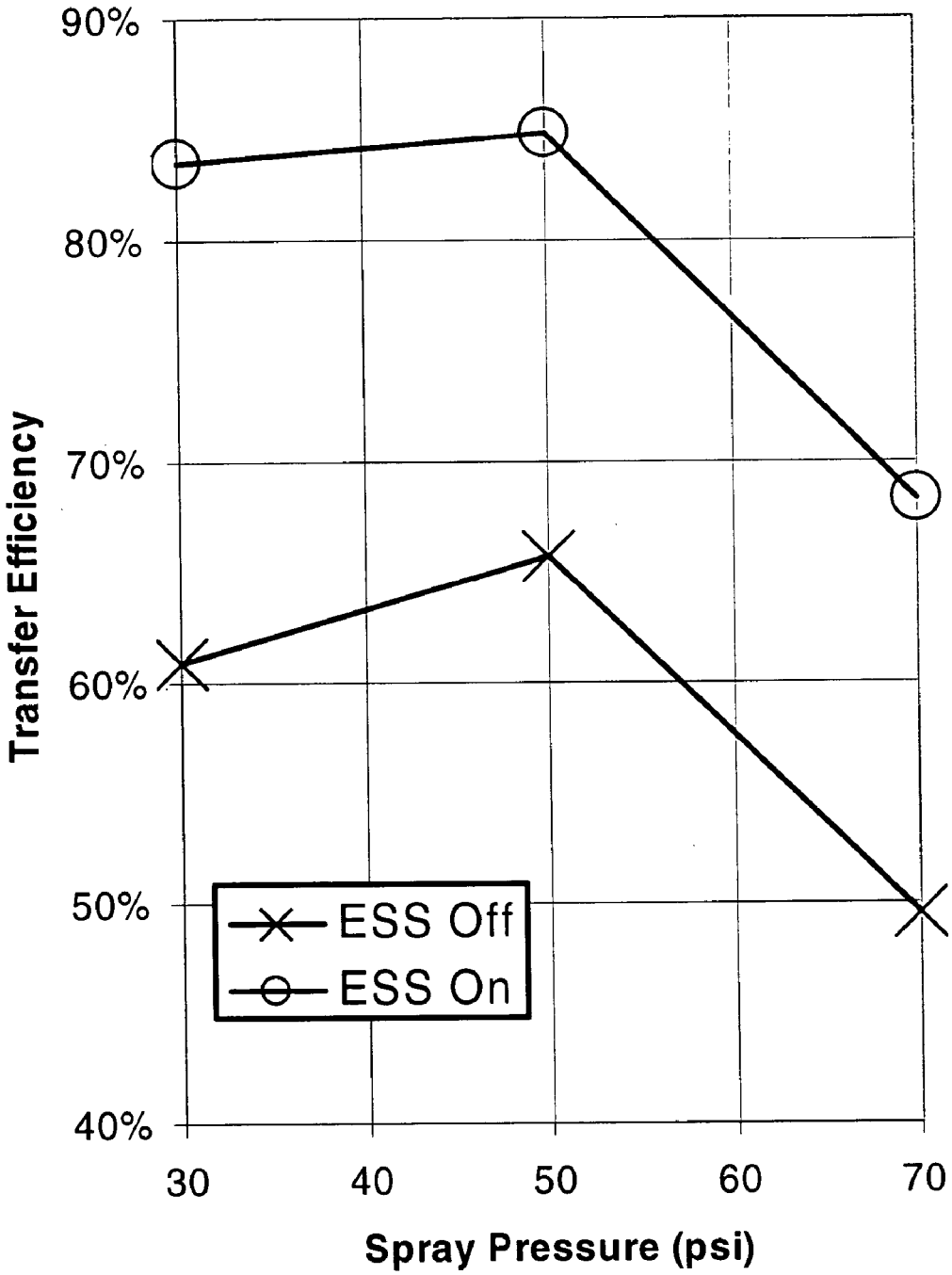
Figure 10 Comparison of transfer efficiency with and without electrostatic charge.

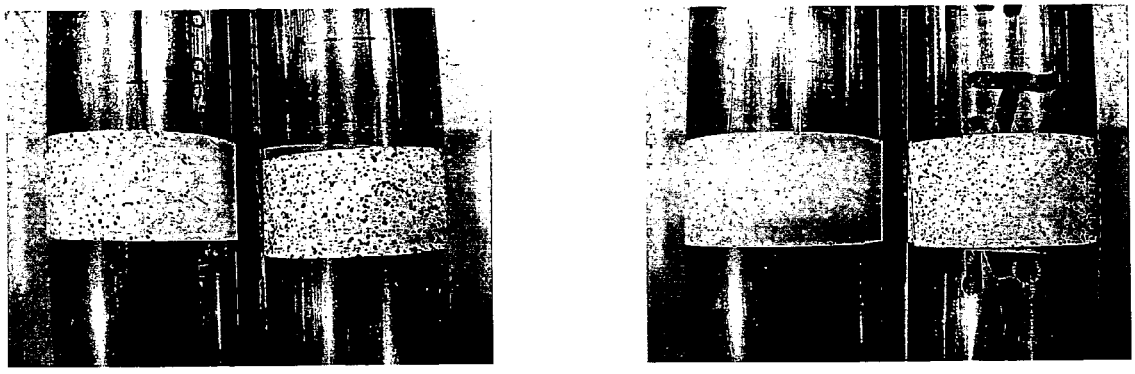
(a) Front (b) Back
Figure 11. Comparison of aerosol spray with and without electrostatic charge on grounded stainless steel cylinder. In both pictures, the left cylinder was sprayed without electrostatic charge and the right cylinder does.

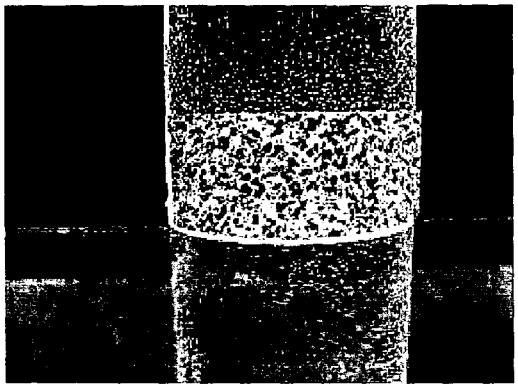
(a) Front of grounded acrylic cylinder
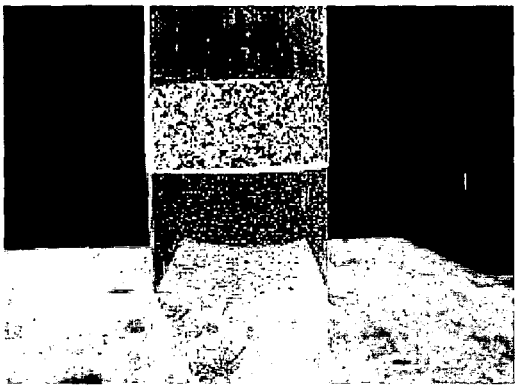
(b) Front of un-grounded acrylic cylinder
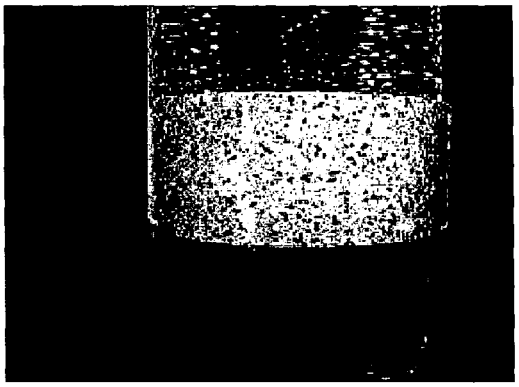
(c) Back of grounded acrylic cylinder
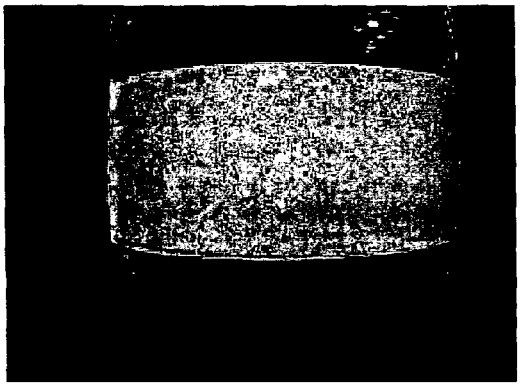
(d) Back of un-grounded acrylic cylinder
Figure 12a-d. Comparison of electrostatic spray on acrylic cylinder with and without ground connection.

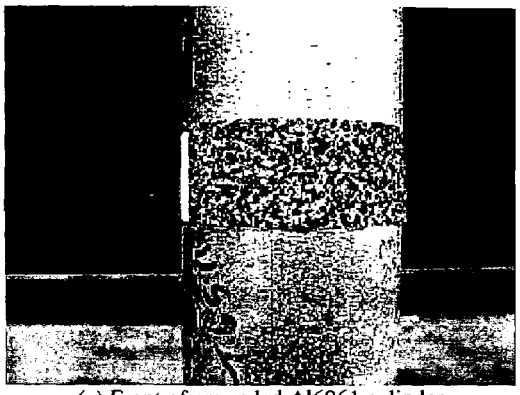
(a) Front of grounded Al6061 cylinder
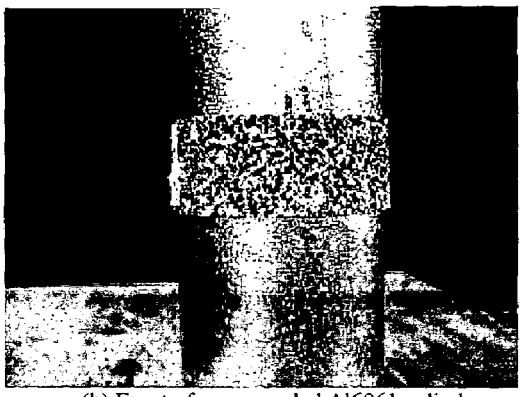
(b) Front of un-grounded Al6061 cylinder
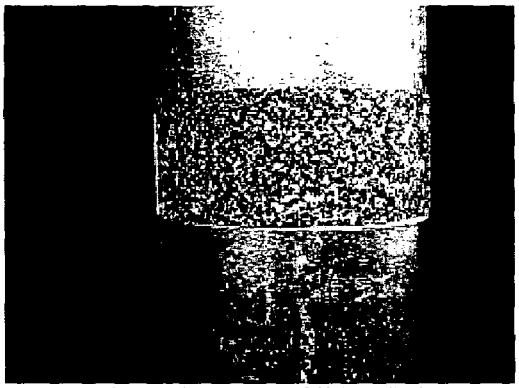
(c) Back of grounded Al6061 cylinder
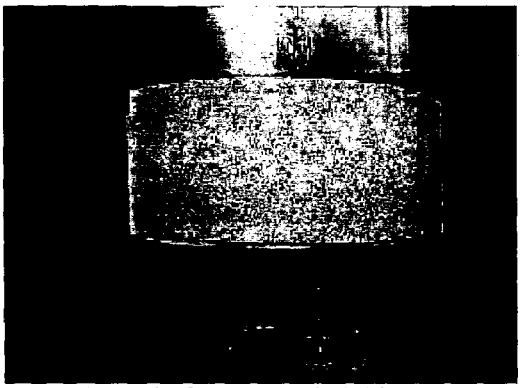
(d) Back of un-grounded Al6061 cylinder
Figure 13a-d. Comparison of electrostatic spray on Aluminum 6061 alloy cylinder with and without ground connection.

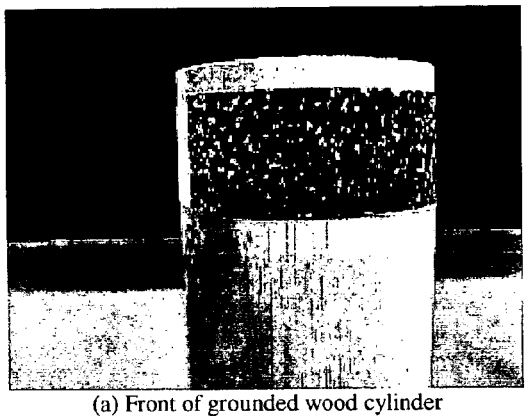
(a) Front of grounded wood cylinder
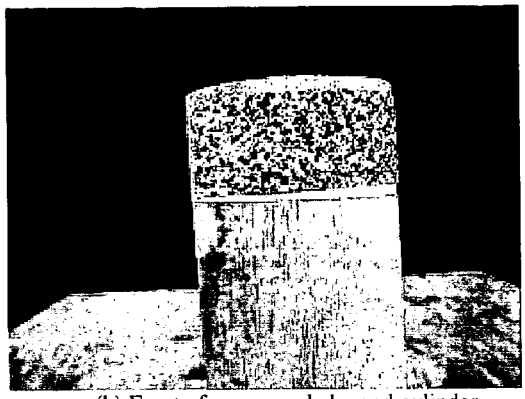
(b) Front of un-grounded wood cylinder
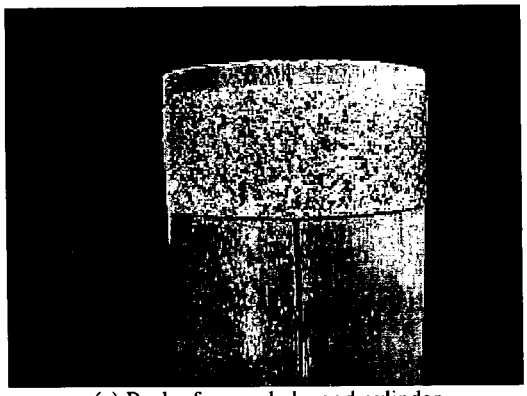
(c) Back of grounded wood cylinder
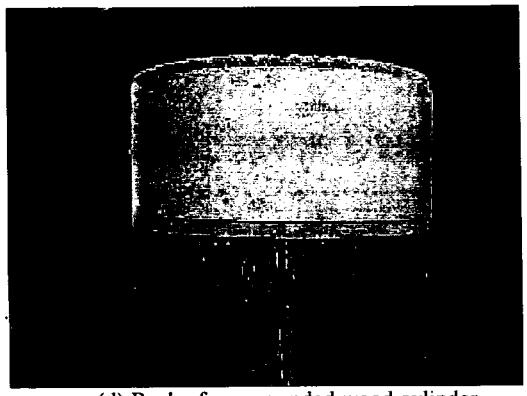
(d) Back of un-grounded wood cylinder
Figure 14a-d. Comparison of electrostatic spray on wood cylinder with and without ground connection.

METHOD AND APPARATUS FOR ELECTROSTATIC SPRAY

CROSS-REFERENCE TO RELATED APPLICATIONS

U.S. Provisional Application No. 60/401,563 filed Aug. 6, 2002.

STATEMENT REGARDING FEDERALLY SPONSORED RESEARCH OR DEVELOPMENT

This work was part of a project supported by the Technical Support Working Group (Contract DAAD05-02-C-0017). The Federal Government retains Unlimited Rights, including the right to use, modify, perform, display, release, or disclose technical data in whole or in part, in any manner or for any purpose whatsoever, and to have or authorize others to do so in the performance of a Government Contract.

APPENDIX

Not Applicable.

BACKGROUND OF THE INVENTION

1. Field of the Invention

This invention relates to electrostatic-spray methods and apparatus, and in particular to methods of and apparatus for adding electric charges onto liquid to improve the atomization of the liquid and the transfer efficiency, also called the delivery efficiency, of the liquid particles onto target objects.

2. Related Art

The electrostatic charging of aerosol particles, e.g., solid particulate or liquid droplets, is a commonly practiced method of improving the transfer efficiency of a spraying process, so that the fraction of the sprayed material that reaches and coats the target is maximal, and the fraction that misses the intended target object or target surface region is minimal.

It is well known in the art that when aerosol particles, i.e., solid particles or liquid droplets, are electrically charged with electrostatic charges and sprayed toward a grounded and electrically conducting object, the electrostatic charges on the particles make an electric field that acts as a mutually repulsive force on the particles that tends to move the particles apart from one another. The charges on individual particles act to maintain the particle's size. The collection of charges on the ensemble of particles induces a distribution of charges on the target object, said induced distribution are called the image charges and have the opposite polarity to the particle charges. The image charges make an electric field that attracts the particles toward the target object. This attractive electrical image force can be sufficiently strong so that it is larger than the drag force of the air that acts on the particles. In this manner, the electric field acts to attract the particles onto the target surface and to reduce or overcome the tendency of the particles to stop prior to reaching the target or to be influenced sufficiently by air currents or forces acting in the transverse direction so that the particles do not reach the target surface. In this way, the electric forces act to improve the transfer efficiency and to obtain better coating, i.e., coverage. This can be especially beneficial on curved or hidden surfaces, i.e., surfaces that are not in the direct 'line of sight' of the sprayer. Furthermore, if the electrostatic charge in a particle exceeds Rayleigh's Limit (see A. G. Bailey, ch. 3), the particle will break into smaller ones as the repulsive force of the electric charge is strong enough that the surface tension or tensile strength of the particle can no longer hold the liquid droplet or solid particle together.

There are many methods to add electrostatic charge onto particles. Tribo-electric charging is a process whereby the electrons on one material are transferred into or onto the other by friction or by different electronic potentials. Although tribo-electric charging is simple, its charge density is low and the process may be unstable. Corona charging is a process wherein electrons are emitted by field-enhanced emission, usually at the sharp tip or edge of a metallic electrode at high electrical potential, e.g., typically, several 10's of kilovolts, and the electrons are accelerated in the high electric field, make collisions with the air molecules, and cause ionization of the air so that an electrical discharge occurs. Subsequently, electrically charged atoms and molecules, i.e., ions, are produced that make collisions with and electrically charge the aerosol particles. Corona is widely applied in solvent-based spray painting industry (U.S. Pat. No. 6,053,437 and U.S. Pat. No. 5,947,377) because the process can generate high charging current, typically as much as 200 μA, and large improvements in the transfer efficiency are obtained. However, in order to prevent the charging current from leaking to ground potential through the liquid path, especially when the liquid is water-based with low electrical resistivity, the reservoir of the liquid must be isolated with heavy insulation material to maintain the contained liquid at a high potential, i.e., a high voltage. The electrical energy stored in such a high-voltage reservoir is very high and could cause deadly electric shock if the operator is not carefully isolated, i.e., insulated from the high voltage. Typically, such insulation comprises an undesirable contribution to the weight and size of the sprayer unit. Another method, called pre-charge, stores electric charge in the liquid stored in an isolated reservoir. Similar to corona, the pre-charge method could add high electric charge into the liquid and aerosol, but the risk of electric shock is also great. Induction is a process where electrical charge is induced onto the liquid droplets or the solid particles as they separate, e.g., as a liquid jet disintegrates into aerosol droplets, from a grounded nozzle and move in an applied electric field that results from the potential applied to an adjacent electrode. Compared to the corona method of charging, the induction method uses a lower applied high voltage, which is typically in the range of one to a few kilovolts. U.S. Pat. No. 5,704,554 taught a method to embed an electrode inside a spray nozzle, where the liquid is atomized by high-velocity compressed air, and to greatly reduce or prevent electric current from leaking to the grounded nozzle by a sophisticated design. U.S. Pat. No. 6,227,466B1, U.S. Pat. No. 6,138,922 and U.S. Pat. No. 6,053,437 proposed methods to simplify the electric wiring and to share one high-voltage power supply for multiple spray nozzles.

One common problem of all of the above corona and induction electrostatic charging methods is that they require high-speed compressed air to atomize the liquid into fine particles. In U.S. Pat. No. 5,704,554, the liquid is pushed out of the reservoir and broken into particles by the pressure differential that results from the vacuum and the shearing forces created by the compressed air flowing through the nozzle. By having compressed air flowing between the electrode and the liquid, a conduction path between the high-voltage electrode and the grounded liquid can be prevented or at least made a very high impedance so as to avoid current leakage that would significantly reduce the charging voltage on the electrode or comprise a significant power loss. U.S. Pat. No. 6,227,466B1, U.S. Pat. No. 6,138,922 and U.S. Pat. No. 6,053,437 adopted similar methods, which vary in the manner of how the high-voltage and ground potential are connected or conducted to the nozzle area. Although a high-speed compressed-air flow can both effectively break the liquid into fine particles and also prevent the formation of an electrical conduction leakage path between the electrode and the nozzle, the air flow could significantly reduce the transfer efficiency as many liquid particles may be carried away by the high-speed air flow and be deflected from the target surface. In some applications, such a high speed air flow is not desirable because the air flow may dislodge particulate or other contamination from the target surface and spoil the purpose for which the sprayed material is applied. An example is the application of a decontaminant spray. In this case, a high-speed air flow may dislodge and blow contamination, e.g., a chemical or biological agent, from the target surface into the atmosphere or onto an adjacent surface, thus comprising the unwanted spread of the contamination material. Another major problem of using compressed air or gas is that it requires either a source of compressed gas such as a chemical reaction, or a container of compressed gas such as a compressed air cylinder or tank, or a significant expenditure of power to obtain the high air pressure and flowrate that are sufficient for the atomization and aerosol delivery. For field applications, i.e., for a portable sprayer, a typical means for obtaining compressed air is an air compressor with a heavy tank and a powerful motor. In a portable situation, such a compressor must be powered by a huge and heavy battery or a powerful generator, if power receptacles are not available.

Another major limitation of the prior art is that the implementation usually requires a specially designed spray gun and unique nozzles that are much more expensive than regular non-electrostatic spray guns. In fact, the additional high capital cost is why electrostatic spraying is applied only in very small percentage of agricultural and industrial applications. Examples are in agriculture for high price crops and in industry for high price products. Without electrostatics, a significant portion of the spray is usually wasted, e.g., spray that misses the target is called overspray. Examples are found in the spraying of pesticides and paint, where overspray not only makes the cost of the application higher, but it also contributes to causing more pollution. More widespread use of electrostatic spraying can be realized if the cost of the electrostatic-spray equipment is less expensive.

Yet another reason for the limited use of electrostatic spraying is the potential hazard posed by the use of high voltage. In one approach, the spray gun is at high potential, typically 60 kilovolts to 120 kilovolts, and the target is electrically grounded. In this case, the applied electric field between the spray gun and the target acts to attract the particles to the target. However, this approach results in exposed high voltage components and the possibility of the spray acting as a conduction path that could result in an inadvertent contact of personnel with the high voltage, and so means to exclude personnel from the vicinity of the spray gun and spray are necessary. In a more common approach, the spray gun is operated at a lower high voltage, typically one to a few kilovolts. In this case, it is still necessary to ensure that personnel do not come into contact with the high voltage parts so that the use of the sprayer is safe. However, in this case, the applied potential is used principally to obtain the aerosol charging and it is a combination of the initial momentum of the spray and the subsequent image force that transports the particles. To make the use of such electrostatic spraying safe as well as practical and economical, it is necessary that the implementation of the charging method have a configuration that avoids the inadvertent contact and shock of personnel and sensitive equipment.

SUMMARY OF THE INVENTION

Generally, according to the process of this invention, an electrode with high voltage is placed at a position near a grounded nozzle made from a conductive material, where the liquid is sprayed by hydraulic pressure or by compressed air. The position of the electrode is chosen to be where the liquid has been atomized to separated particles to avoid electric current leaking through the connected liquid path to the grounded nozzle. The electrode should not be so close to the sprayed particles or the liquid jet that the particles lose charge to the electrode or so far that the electric field becomes too weak in the region between the electrode and the nozzle to induce a high charging current. The shape of the electrode should be similar to the sprayer pattern, e.g. an axisymmetric circular aperture electrode to produce a circular cone spray, or two linear electrodes, one on each side of a flat spray, e.g., a fan spray or a sheet spray, so that electric charges can be induced onto the majority of the liquid particles. In this process, the charge on the sprayed particles has the polarity that is opposite to the voltage, i.e., electrical potential, on the electrode. When spraying a conductive liquid, according to a preferred embodiment of this invention, the electrode is mounted on a non-conducting electrode holder through which an electrically conducting cable connects the electrode to the high voltage power supply, and this electrode holder is surrounded by an electrically insulating concave cup. The open end of the cup is situated away from the direction of the spray so that the insulating cup maintains a dry surface on a portion of the electrode holder so that a significant electric current will not leak from the electrode to a grounded surface via the wetted surfaces and cause a significant drop in the voltage on the electrode. In another embodiment according to this invention, the electrode is positioned close enough so that the particles of the high-pressure jet will collect charges of the same polarity from the electrode and also have sufficient speed so that the charge cannot drain back to the electrode as the particle moves forward with the spray away from the electrode.

The spray, which is electrostatically charged, exits from the sprayer with momentum directed at a target. The electric 'space-charge' of the charged particles in the spray induce image charges in nearby conducting objects. If the target is conducting, then the spray is attracted to the target as well as carried by its momentum as it encounters the drag force associated with the viscosity of the air. For a non-conducting target, the initial deposition of spray having sufficiently low resistivity may change the non-conducting target surface into a conductive one. If there is an adjacent ground, then the non-conducting target may then act as a conducting target. Furthermore, the target may be also be at a potential that is different from the electrode in the sprayer. In this manner, the associated applied electric field can act in concert with the direct momentum and the image force to attract the sprayed particles onto the target.

In the preferred embodiments of this invention, the high voltage is generated with an unregulated, low-power, typically less than 5 W, converter that convert a low-voltage, e.g. 0–15 V, DC input into a high-voltage, e.g. 1–20 kV, DC output. The spray gun can be any existing airless gun where the liquid is atomized by the hydraulic pressure or an air gun that uses compressed air to break the liquid into particles, provided that the spray nozzle is electrically conductive and grounded. The electric connection between the nozzle and ground can be achieved with an electric wire or simply through the liquid path, if the liquid's resistivity is not very high. The electrostatic spray gun in this invention is relatively safe because the spray gun and the liquid path are grounded and, when a short circuit occurs, the output voltage of the converter will quickly drop to the same level as the input to avoid electric shock.

In a preferred embodiment, multiple nozzles are mounted on a single manifold so that the liquid is sprayed simultaneously from the multiple nozzles. A single electrode is positioned at an optimal location. This electrode may be non-planar to accommodate the various angular orientations of the flow from the nozzles. The electrode has at least one opening, e.g., a single slit, or multiple openings through which the sprayed particles flow. In a preferred embodiment with multiple nozzles, the electrode comprises a flat metal strip having a long rectangular opening, and the metal strip is bent in two places so that the electrode presents a planar portion adjacent to each electrode.

Surrounding the manifold, nozzles, and electrode is a conducting electrode cover, which also has an opening so that the sprayed particles can exit the assembly with minimal interception of particles from the spray by the cover. This conducting electrode cover is to be grounded as are any exterior metal parts of the spray gun so that the build-up of charge or a dangerous electrical potential on any exposed surface of the spray gun assembly is avoided. In this way, the electrode cover acts as an electrical safety shield, and the operator is protected from inadvertent contact with an exposed surface at high voltage. Although the electric field between the conductive electrode cover and the electrode may act to slow the aerosol particles, the change in velocity is small, typically, even for particles with charge that is comparable to the Rayleigh limit.

Because this electrostatic method can be applied with most of the existing commercial non-electrostatic spray guns, and because the cost of adding an electrode and an unregulated low-power converter is relatively low, the electrostatic method in this invention is much more economic than those in the prior art.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings:

FIG. 8 is the particle size distribution of spray nozzle 250050.

FIG. 9 is the Rayleigh limit of charge density on water particles.

FIG. 10 is a comparison of transfer efficiency of water spray with and without electrostatic charge.

FIG. 11 is a comparison of the spray of water on a grounded metal cylinder with and without electrostatic spray.

FIG. 12 is a comparison of electrostatic spray of water on an acrylic cylinder with and without ground connection.

FIG. 13 is a comparison of electrostatic spray of water on a metal cylinder with and without ground connection.

FIG. 14 is a comparison of electrostatic spray of water on a wood cylinder with and without ground connection.

DETAILED DESCRIPTION OF THE PREFERRED EMBODIMENTS

Figure 1:
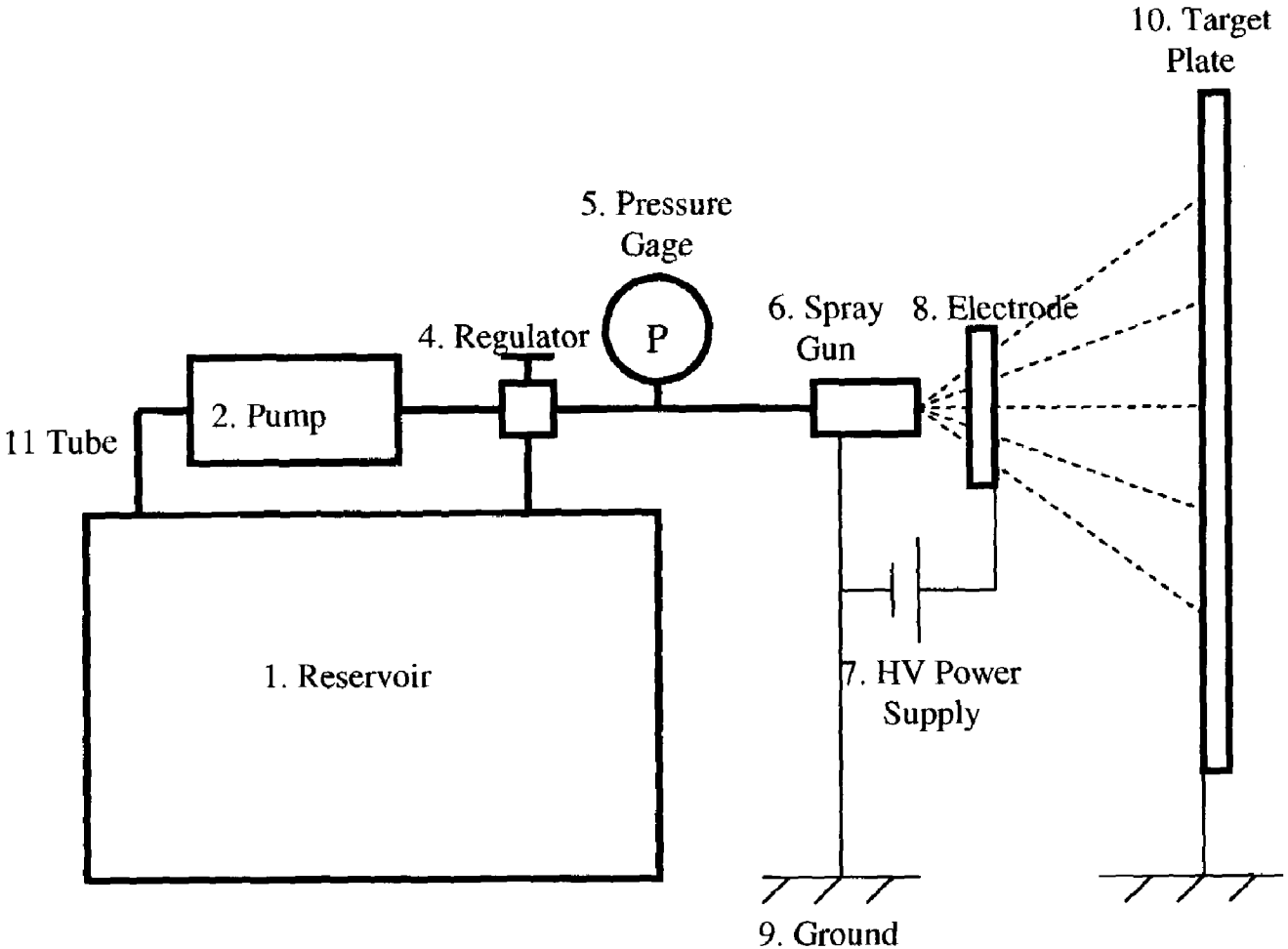
FIG. 1 is a block diagram of the apparatus of electrostatic spray.

An apparatus for electrostatic spray in accordance with the principles of the present invention is illustrated schematically in FIG. 1. The liquid or particles to be sprayed are contained in reservoir 1, which is connected by a tube 11 to a pump 4. The spray pressure is controlled by a regulator 4 and displayed by a pressure gage 7. The spray gun 6 is an integration of a valve and nozzle where the liquid or powders separate into particles. The electrostatic charge is induced from the ground 9 through the spray gun onto the particles by the high voltage on the electrode 8. The high voltage is generated by a high-voltage (HV) converter 7 which converts a low voltage DC signal into high-voltage DC output. The particles are sprayed toward a grounded object 10, e.g. a plate, where the charge on the particles is conducted back to ground 9. Instead of airless spray, the liquid or the powder could be atomized by compressed air supplied from an air compressor (not shown) into the spray gun.

Figure 2:
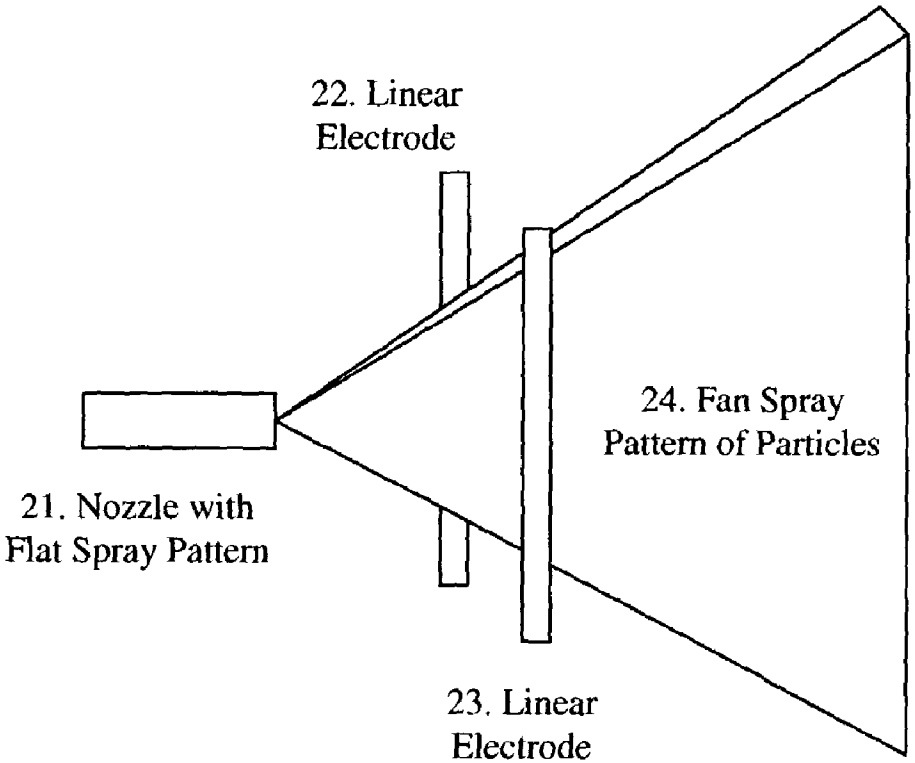
FIG. 2 is a schematic of a flat spray gun with an added pair of straight electrode.
Figure 3:
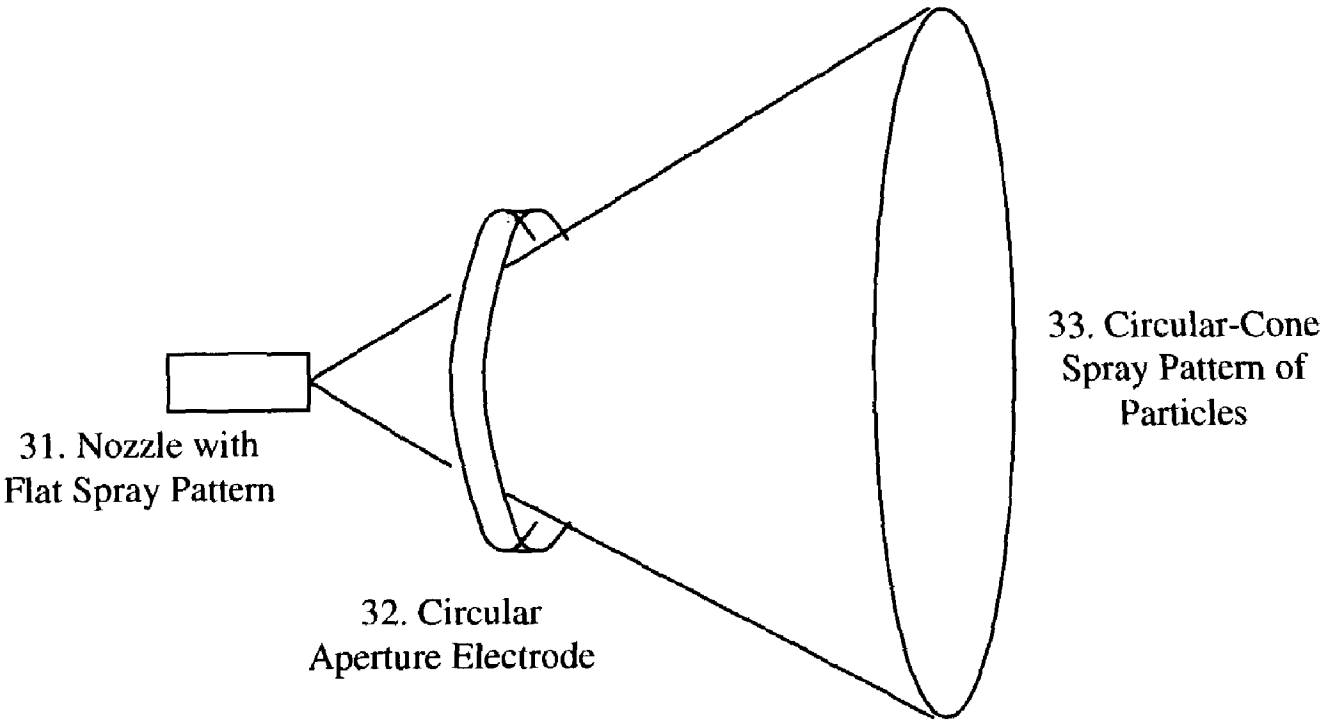
FIG. 3 is a schematic of a circular-cone spray run with an added circular electrode.
Figure 4:
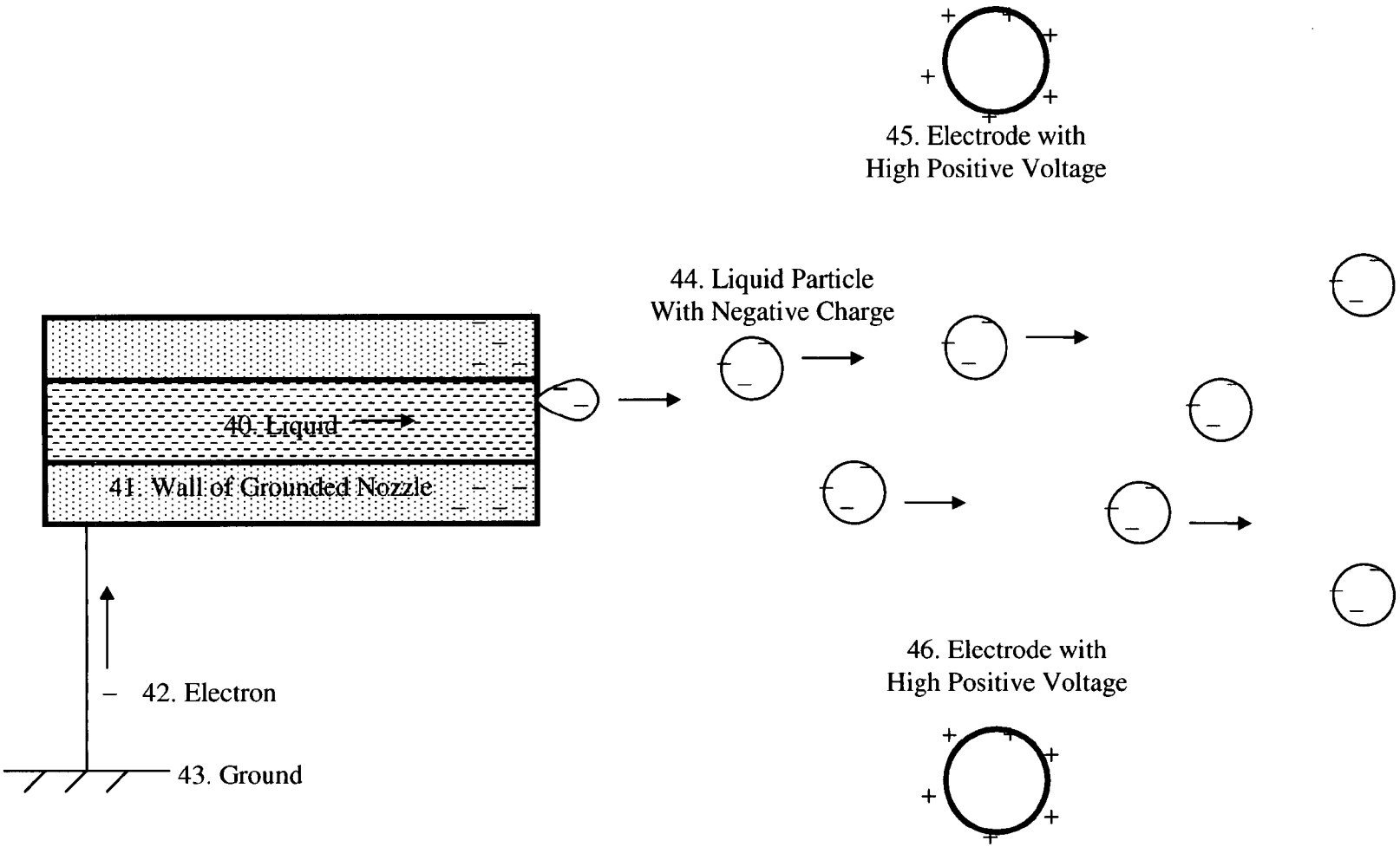
FIG. 4 is a schematic of one preferred embodiment of electrostatic spray (opposite charge).

The electrostatic apparatus in this invention is adaptable for spray guns with hydraulic and compressed-air atomization and for liquid with high or low electric resistivity. Generally, a spray gun with a spray nozzle made with electrically conductive material is required. The nozzle must be connected to ground with an electric cable or through the fluid path, if the fluid is conductive. If the spray-gun body is also conductive, the ground cable can also be connected to the spray gun. The profile of the electrode should cover the complete periphery of the sprayed patterns of the particles to maximize the electrostatic charges. As shown in FIG. 2, the particles in a flat-fan spray pattern 24 can be charged with a pair of linear electrodes 22, 23, one on each side. For a circular-cone spray pattern 33, as shown in FIG. 3, an axisymmetric aperture electrode 32 could provide appropriate coverage of most of the particles. In a preferred embodiment of this invention, as shown in FIG. 4, the electrode 45, 46 should not be too close to the spray nozzle 41 that the partially atomized liquid 44 can form an electrically conducting path with low resistance. The electrode should not be positioned so far away from the nozzle either that the electric field in the region between the electrode and the nozzle is too low to induce the desired charge on the particles.

Because the atomization depends very much on the nozzle design, the spray pressure and the liquid's properties, the optimal position between the electrode and the nozzle can be determined by experiment. An example of such an experiment is the measurement of the average charge density on a particle, i.e., the mean of the ratio of the electric charge and the particle volume, the ratio being a function of electrode position and the width of the electrode opening. Another such experiment is the determination of the ratio of the sprayed electrical current and the sprayed volumetric flow rate that exits the sprayer apparatus, this ratio being another indication of typical charge density on a particle and being a function of the electrode position and width of its opening.

Figure 5:
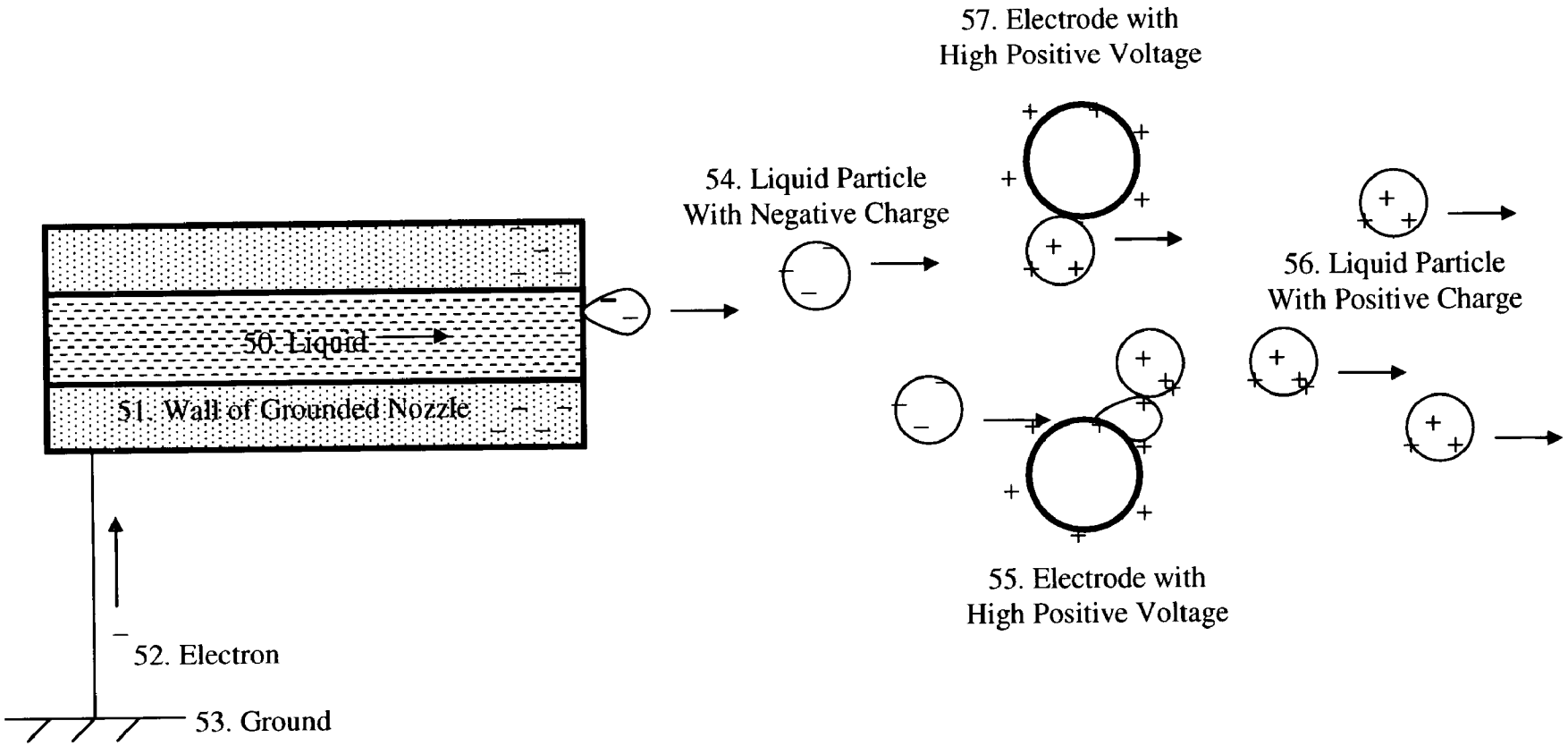
FIG. 5 is a schematic of another preferred embodiment of electrostatic spray (same charge).

An observation of our tests is a basic rule of thumb: that the optimal distances from the electrode to the nozzle and to the sprayed jet decrease with better atomization. In another preferred embodiment of this invention, as shown in FIG. 5, the electrodes 55, 57 are positioned very close to a high pressure jet of particles 54 that the particles can pick up charges from the electrodes by direct or indirect contact and still have sufficient momentum to break away from the electrodes.

Figure 6:
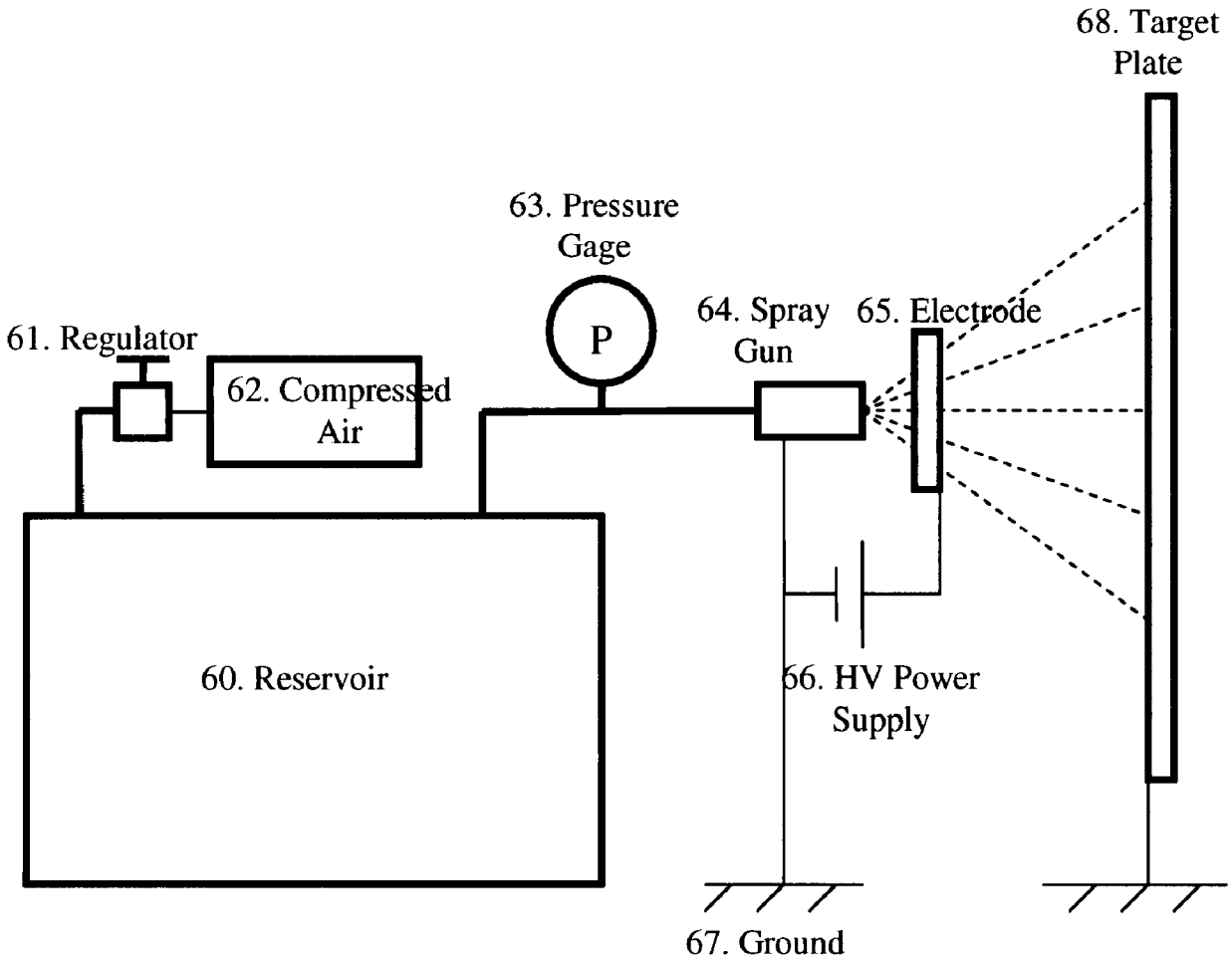
FIG. 6 is a schematic of a lightweight electrostatic spray system

As shown in FIG. 6, when a lightweight electrostatic spray system is preferred, the liquid in the reservoir 60 can be pressurized with compressed air from a high-pressure vessel 62. By using a regulator 61 to adjust the output pressure of the compressed air, one can control the spray pressure, displayed on the pressure gage 63, and the corresponding flow rate in a wide range. Since the density of air is very low, even at high pressure, one can store sufficient amount of compressed air at a high pressure, e.g. to 4,500 psi, in a commercially available re-chargeable composite high-pressure vessel that is very light weight. For safety and reliability, both the liquid reservoir and the compressed-air vessel must meet the ASME specifications for high-pressure vessels.

Tests were performed to determine the optimized critical dimensions and parameters of the sprayer components. Spray efficiency was measured for various values of electrode to nozzle spacing, 0.3, 0.6, 0.9, 1.2, and 1.5 inches. The significant improvement with a broad peak was obtained for the range of 0.8 to 1.4 inches. In a preferred embodiment, the electrode is positioned 1.1 inches from the nozzle, which has a 0.018 inch diameter orifice. The liquid is pressurized to a working range of 30 to 60 psi, for which the flow rate is in the range of approximately 0.5 to 1 liter per minute. The electrode opening was varied for other tests with the width ranging from 0.2 to 1.0 inches, while the electrode to nozzle spacing was 1.1 inches. High spray efficiency was achieved for a width in the range of 0.4 to 0.8 inches. In a preferred embodiment, the best results are obtained for a width of 0.6 inches.

The high voltage converter used in a preferred embodiment is an EMCO No. E121. This converter is powered by 12 VDC from a multi-cell battery pack. The 10 kilovolt output is connected to the electrode by a high voltage insulated cable rated at 15 kilovolts. The converter is potted, i.e., embedded in plastic, inside of a grounded aluminum housing. An on-off switch is mounted into the housing and connected to the input of the converter.

The materials of a preferred embodiment are selected to be non-corrosive, strong, and lightweight. The conductive plastic electrode cover is made of conductive polyethylene and ultra-high molecular weight (UHMW) TIVAR 1000 (antistatic). The opening of the electrode cover is 0.375 inches to permit the spray to exit the assembly with minimum interception and also to reduce the likelihood of inadvertent insertion of a finger into assembly and contact with the high voltage electrode. The spray gun is nylon. The manifold is acetal copolymer. In a preferred embodiment, the electrode and nozzles are made of stainless steel.

In a preferred embodiment with three nozzles, the nozzles are oriented with an angular spacing of 25 degrees and produce co-planar 'fan-shaped' sprays. The angular spacing may be varied according to the width of the spray pattern desired on the target, with consideration to flow rate and the sweeping rate, i.e., the relative motion between the sprayer and the target.

To date, a series of tests have been carried out to test the feasibility of the concepts in this invention. In one test, a Graco 243285 spray gun with a Graco 286515 flat-fan spray nozzle was connected to a Graco 395 St Pro Electric Paint Spray Pump to spray tap water. The electrode set up is similar to FIG. 2 and FIG. 5. With a voltage at 6 kV and spray pressure between 200–2,000 psi, the measured current from the sprayed metal plate to ground was about 2–6 μA, and was the same polarity as the voltage on the electrode.

Figure 7:
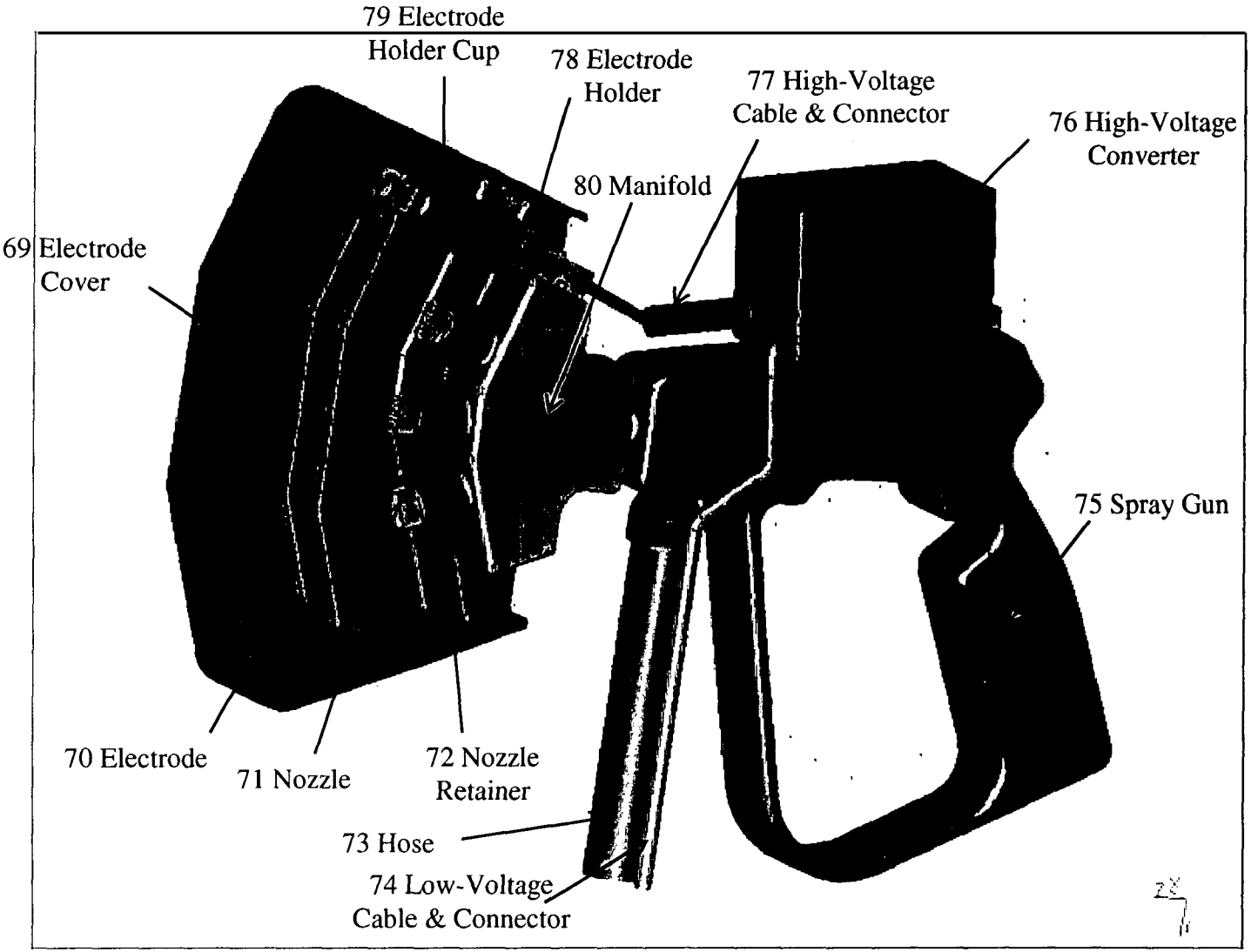
FIG. 7 is the solid model of a prototype electrostatic spray gun designed with commercially available non-electrostatic spray nozzle, Spray System Co. 250050, and spray gun, Spray System Co. 30L-PP.

In another test, as shown in FIG. 7, a Spray System 30L-PP spray gun with a TP-250050-SS spray nozzle was used to spray tap water at a pressure at 30 psi. On the electrode holder 78, there is a electrode holder cup 79 that covers and keeps part of the electrode holder dry to prevent current leakage through the wetted surface. The measured charge density was 0.6–0.7 milli-coulomb. Based on the measured particle size distribution, as shown in FIG. 8 and the Rayleigh limit of charge density, as shown in FIG. 9, the maximum charge density of the water particles sprayed with 250050 nozzle at 30 psi is found to be 2.14 milli-coulomb. As the measured charge density is comparable, i.e., in the same order, as the Rayleigh limit, it is implied that some of the larger water particles could have been refined due to the electrostatic charge. As shown in FIG. 10, when water is sprayed toward a grounded metal plate from a 2-ft distance, the transfer efficiency increases from 50%–65% without electrostatic charge to 70%–85% with electrostatic charge.

To evaluate the electrostatic effects on curved hidden surface, we sprayed water at 30 psi toward a grounded, circular metal cylinders wrapped with water sensitive paper which changes color from yellow to blue when it is wetted. As shown in FIG. 11, the number of water marks on the paper increases significantly, especially on the back side of the cylinder, when the sprayed water particles are charged with electrostatic. To evaluate the effects of ground connection and the object's electric resistivity on the transfer efficiency, we sprayed water with electrostatic charge toward circular cylinders made of acrylic, wood and metal with and without ground. As shown in FIGS. 12–14, it is clearly seen, regardless of the object's electric resistivity, that having an adjacent ground connection has a significant positive impact on the transfer efficiency. The results indicates that, even when object's resistivity is high and the sprayed particles' resistivity is high, the sprayed particles form a sufficiently conductive coating on the object so that the electrostatic charge received by the object from the incident current of the charged particles, typically in the μA range, can still flow to ground such that the electric potential of same polarity as the charged particles will not build up on the object and cause a significant repelling effect. This effect has been demonstrated in the spraying of water and in the spraying of a photosensitizer solution.

The new electrostatic sprayer described herein is particularly well suited for the application of photosensitizer solution to a conducting or non-conducting surface for subsequent illumination with ultraviolet light. The photosensitizer solution for such application comprises a conductive solution with a typical resistivity being of the order of 1 to 10 kilo-Ohm-cm. With the initial deposition of such a sprayed solution, the initially non-conducting object with adjacent ground connection acts as a conducting surface and the benefits of the electrostatic spraying such as the high transfer efficiency and the wraparound effect are realized.

The companies cited above are: Emco High Voltage Corporation, 11126 Ridge Road, Sutter Creek, Calif. 95685; Graco, Inc. 2 St. Louis Road, Collinsville, Ill. 62234; and Sprayer System Co., North Avenue at Schmale Road, Wheaton, Ill. 63189-7900.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the relative size of the nozzle, electrode, etc. may all be increased or decreased to achieve the same result. Thus, the breadth and scope of the present invention should not be limited by any of the above-described exemplary embodiments, but should be defined only in accordance with the following claims appended hereto and their equivalents.

What is claimed is:

1. A method of spraying an aerosol spray, comprising:

providing a grounded nozzle and an electrode separated by a predetermined axial distance;

providing a grounded conductive cover around said nozzle and said electrode, said cover having an opening that allows a directed spray to exit;

placing said electrode at a high electrical potential relative to said nozzle, thereby creating an electric field between said nozzle and said electrode;

ejecting a liquid or powder from said nozzle towards said electrode to atomize the ejected liquid or powder into aerosol droplets or particles so that in the applied electric field between said nozzle and said electrode, said aerosol droplets or particles obtain an induced electric charge;

after the aerosol droplets or particles pass the vicinity of said electrode, forming a directed spray of aerosol droplets or particles having a desired shape and with sufficient momentum and electric charge so that said directed spray of aerosol droplets or particles is deposited on a target.

2. The method of claim 1 wherein said aerosol droplets or particles are at a predetermined distance from said electrode.

3. The method of claim 1, wherein said liquid or powder has an electrical resistivity in the range of 200 Ohm-cm to 40 kilo-Ohm-cm.

4. The method of claim 1, further comprising:

providing an electrical connection to said electrode; and providing an insulating electrode holder surrounding said electrical connection to said electrode, said insulating electrode holder having a concave shape to keep said electrode holder dry and thereby preventing formation of a continuous wetted surface between said electrode and a grounded surface.

5. The method of claim 4, wherein said electrode holder comprises a material having a low force of attraction for said droplets or particles.

6. The method of claim 1 wherein said providing a grounded nozzle and an electrode separated by a predetermined distance further comprises:

providing a grounded nozzle and an electrode separated by a predetermined distance in a direction of spraying.

7. The method of claim 1 wherein said aerosol droplets or particles obtain an induced electric charge by direct contact with said electrode.

8. The method of claim 1 wherein said predetermined axial distance is equal to or greater than approximately 0.3 inches.

9. The method of claim 1 wherein said predetermined axial distance is between approximately 0.3 inches and approximately 1.5 inches.

10. The method of claim 1 wherein said predetermined axial distance is between approximately 0.8 inches and approximately 1.4 inches.

11. The method of claim 1 wherein said predetermined axial distance is approximately 1.1 inches.

12. The method of claim 1 wherein the polarity of the induced electric charge on said aerosol droplets or particles is the same as the polarity of said electrode.

13. A method of spraying an aerosol spray, comprising:

providing a grounded nozzle and an electrode separated by a predetermined axial distance;

placing said electrode at a high electrical potential relative to said nozzle, thereby creating an electric field between said nozzle and said electrode;

ejecting a liquid or powder from said nozzle towards said electrode to atomize the ejected liquid or powder into aerosol droplets or particles so that in the applied electric field between said nozzle and said electrode, said aerosol droplets or particles obtain an induced electric charge;

after the aerosol droplets or particles pass the vicinity of said electrode, forming a directed spray of aerosol droplets or particles having a desired shape and with sufficient momentum and electric charge so that said directed spray of aerosol droplets or particles is deposited on a target;

providing an electrical connection to said electrode; and providing an insulating electrode holder surrounding said electrical connection to said electrode, said insulating electrode holder having a concave shape to keep said electrode holder dry and thereby preventing formation of a continuous wetted surface between said electrode and a grounded surface.

14. The method of claim 13, wherein said electrode holder comprises a material having a low force of attraction for said droplets or particles.

15. The method of claim 13, further comprising:

a manifold;

a second nozzle mounted on said manifold; and wherein said electrode has a shape adapted to provide the same distance between said electrode and said nozzle and said second nozzle.

16. The method of claim 13, further comprising:

providing a grounded conductive cover around said nozzle and said electrode, said cover having an opening that allows a directed spray to exit.

17. The method of claim 13, wherein said liquid or powder has an electrical resistivity in the range of 200 Ohm-cm to 40 kilo-Ohm-cm.

18. The method of claim 13 wherein the polarity of the induced electric charge on said aerosol droplets or particles is the same as the polarity of said electrode.

19. The method of claim 13 wherein said aerosol droplets or particles obtain an induced electric charge by direct contact with said electrode.

* * * * *